US008272093B2

(12) United States Patent
Wu

(10) Patent No.: US 8,272,093 B2
(45) Date of Patent: Sep. 25, 2012

(54) CLOTH DISC ASSEMBLY FOR MOP

(76) Inventor: Ying-Ching Wu, An-Ding Shiang (TW)

( * ) Notice: Subject to any disclaimer, the term of this patent is extended or adjusted under 35 U.S.C. 154(b) by 399 days.

(21) Appl. No.: 12/765,264

(22) Filed: Apr. 22, 2010

(65) Prior Publication Data

US 2011/0258799 A1 Oct. 27, 2011

(51) Int. Cl.
*A47L 13/255* (2006.01)

(52) U.S. Cl. ..... 15/229.1; 15/228; 15/229.6

(58) Field of Classification Search ..... 15/228, 15/229.1, 229.6, 147.1, 147.2
See application file for complete search history.

(56) References Cited

U.S. PATENT DOCUMENTS 8,112,840 B2 * 2/2012 Chen et al. ..... 15/229.6
2011/0016652 A1 * 1/2011 Chu ..... 15/228
* cited by examiner

*Primary Examiner* — Shay Karls
(74) *Attorney, Agent, or Firm* — Alan Kamrath; Kamrath IP Lawfirm, PA

(57) ABSTRACT

A cloth disc assembly for a mop includes a disc having engaging holes. A fixing member is mounted to each engaging hole and includes a cylinder having a longitudinal hole. The cylinder further includes an engaging section formed on an outer periphery thereof and engaged in one of the engaging holes. A fixing hole extends from the outer periphery of the cylinder through an inner periphery of the longitudinal hole. A cleaning unit is extended through the longitudinal hole of the cylinder of each fixing member and includes a plurality of cleaning strips each having two ends extending out of the cylinder. A positioning member is mounted to each fixing member and includes a shank extending through the fixing hole of the cylinder of each fixing member into the longitudinal hole of the cylinder and pressing the cleaning strips against the inner periphery of the longitudinal hole of the cylinder.

6 Claims, 6 Drawing Sheets

CLOTH DISC ASSEMBLY FOR MOP

BACKGROUND OF THE INVENTION

The present invention relates to a cloth disc assembly for a mop and, more particularly, to a cloth disc assembly that is detachably mounted to a lower end of a stick of a mop and that can be driven to dehydrate cleaning strips of the cloth disc assembly.

A type of currently available mop includes a stick and a cloth disc assembly attached to a lower end of the stick. Cloth fixed on a disc of the cloth disc assembly can be placed in a dehydrating cylinder that can be rotated to dehydrate the cloth. The disc includes circular cross sections and a plurality of fixing holes each receiving a cleaning unit consisting of includes a plurality of bundled cleaning strips made of cloth or cotton. Each cleaning strip is folded in two, and the folded portions are frictionally fixed in one of the fixing holes with each cleaning strip having two dangling ends. The cleaning units can be utilized to absorb water and clean floors. However, special tools are required to squeeze the cleaning units into each fixing hole. Furthermore, the cleaning strips of each cleaning unit must be equal to each other by cutting. As a result, manufacturing of the cloth disc assemblies with such a cleaning unit is time-consuming and expensive.

Thus, a need exists for a cloth disc assembly that can be rapidly manufactured in mass production to reduce the manufacturing time and costs.

BRIEF SUMMARY OF THE INVENTION

The present invention solves this need and other problems in the field of mass production of mops by providing, in a preferred form, a cloth disc assembly including a disc having a ring with upper and lower surfaces spaced along a longitudinal axis of the disc. A plurality of engaging holes extends from the upper surface through the lower surface along the longitudinal axis of the disc. The disc is adapted to be coupled to a stick of a mop. A fixing member is mounted to each engaging hole and includes a cylinder having first and second end faces. A longitudinal hole extends from the first end face through the second end face of the cylinder. The cylinder of each fixing member further includes an outer periphery extending between the first and second end faces and having an engaging section formed on the outer periphery of the cylinder. The engaging section of the cylinder of each fixing member is engaged in one of the engaging holes with the lower surface of the ring intermediate the upper surface of the ring and the cylinder along the longitudinal axis of the disc. The cylinder of each fixing member further includes a fixing hole extending from the outer periphery of the cylinder through an inner periphery of the longitudinal hole of the cylinder. A cleaning unit is extended through the longitudinal hole of the cylinder of each fixing member. Each cleaning unit includes a plurality of cleaning strips each having two ends extending out of the first and second end faces of the cylinder and outside of the disc. A positioning member is mounted to each fixing member and includes a shank extending through the fixing hole of the cylinder of each fixing member into the longitudinal hole of the cylinder and pressing the cleaning strips against the inner periphery of the longitudinal hole of the cylinder.

In the most preferred form, the fixing hole of the cylinder of each fixing member is a screw hole. A receptacle extends from the inner periphery of the longitudinal hole of the cylinder of each fixing member into the engaging section of the fixing member. The receptacle is a conical screw hole aligned with the fixing hole. The shank includes a threaded outer periphery engaged in the screw hole and has an end engaged in the conic screw hole. The engaging section of each fixing member includes an enlarged head outside of the engaging holes and abutting the upper surface of the ring. The ring includes inner and outer peripheries spaced in a radial direction perpendicular to the longitudinal axis of the disc. An outer annular wall is formed along the outer periphery of the ring. An inner annular wall is formed along the inner periphery of the ring and radially inwards of the outer annular wall. An upper annular groove is formed between the upper surface and the inner and outer annular walls. A lower annular groove is formed between the lower surface and the inner and outer annular walls. The cylinder of each fixing member is received in the lower annular groove. The enlarged head of each fixing member is received in the upper annular groove.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
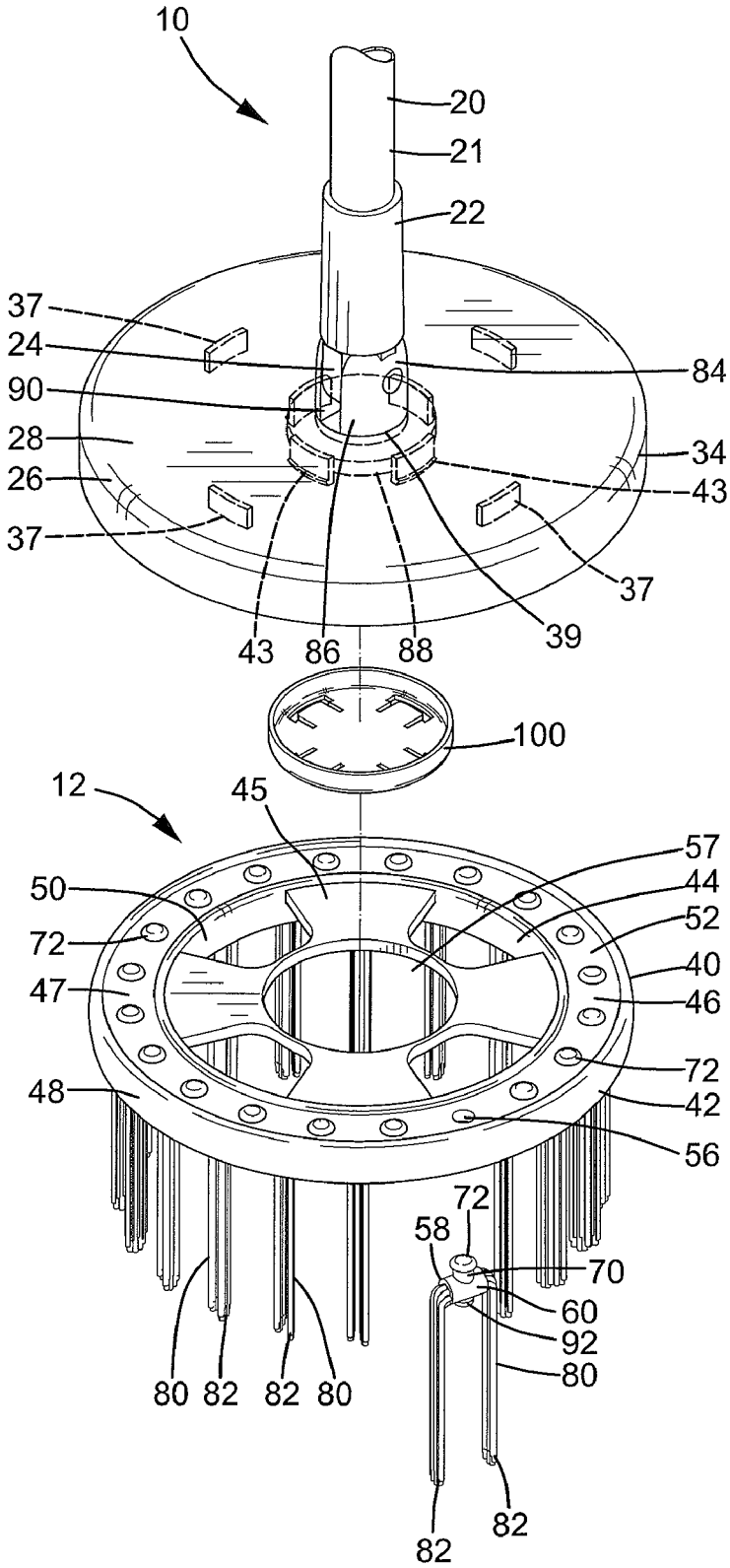
FIG. 1 shows a partial, exploded, perspective view of a mop utilizing a cloth disc assembly according to the preferred teachings of the present invention.
Figure 2:
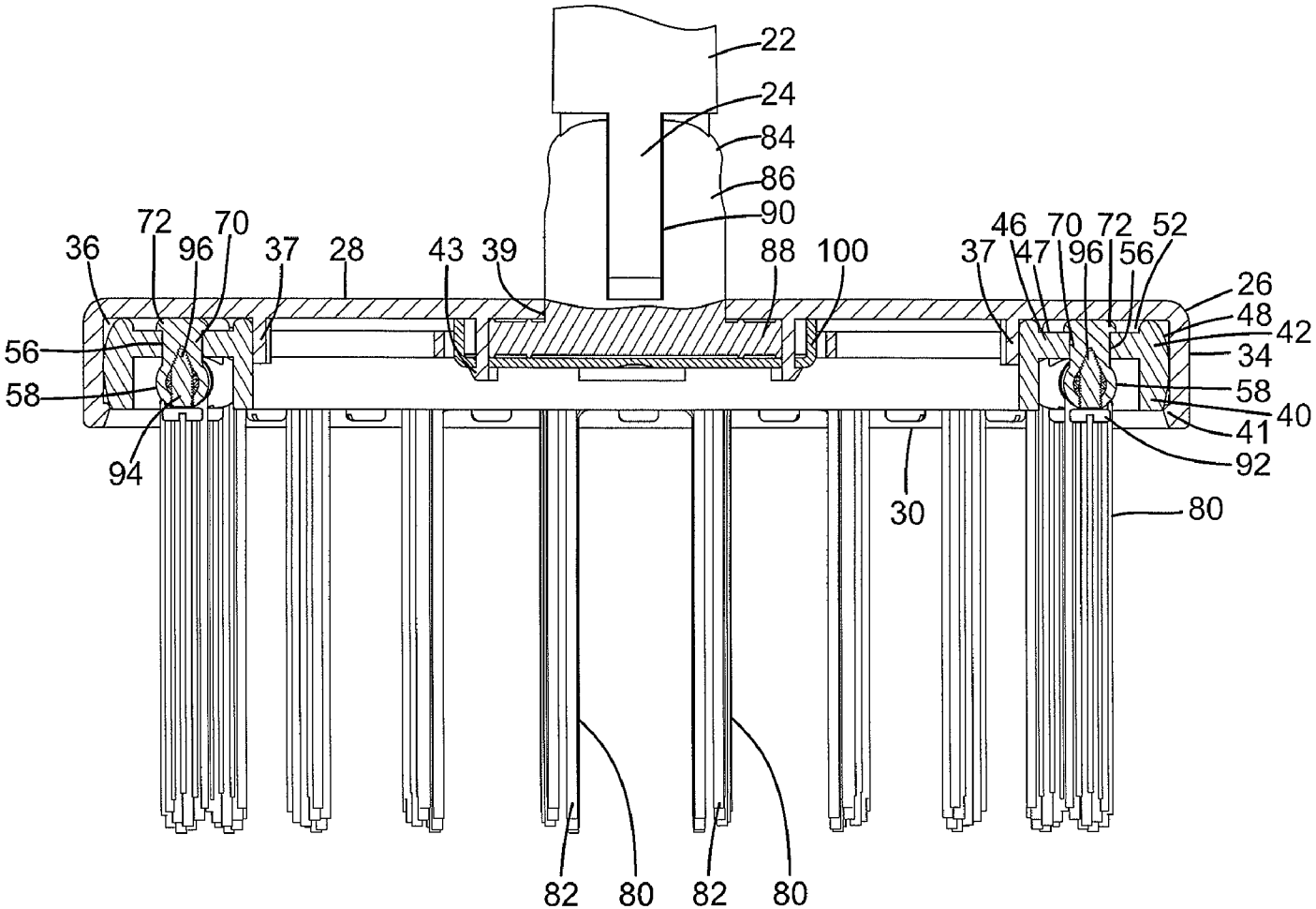
FIG. 2 shows a partial, cross sectional view of the mop of FIG. 1.
Figure 3:
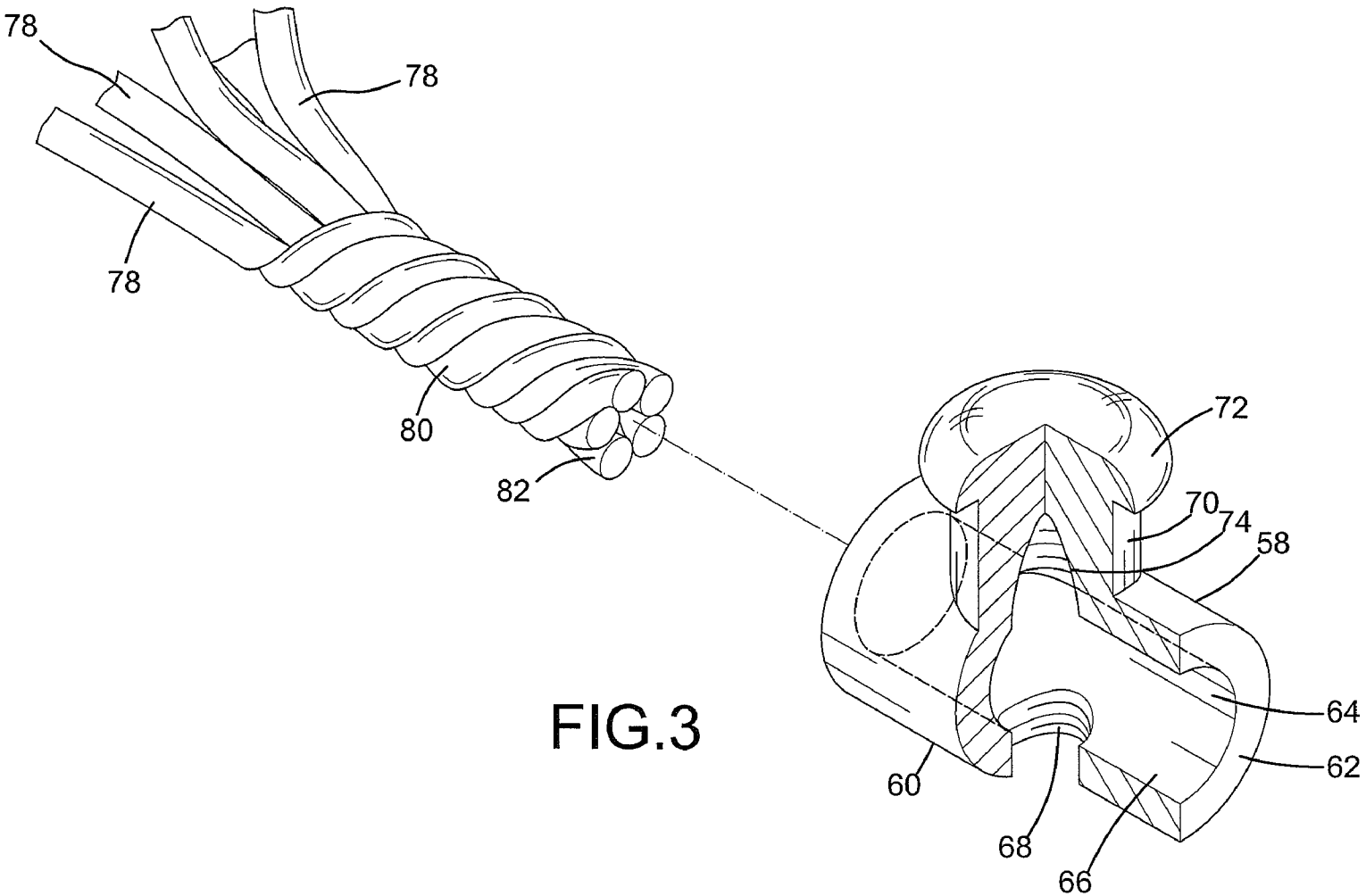
FIG. 3 shows a perspective view of a cleaning unit and a fixing member of the mop of FIG. 1 with portions of the fixing member broken away.
Figure 4:
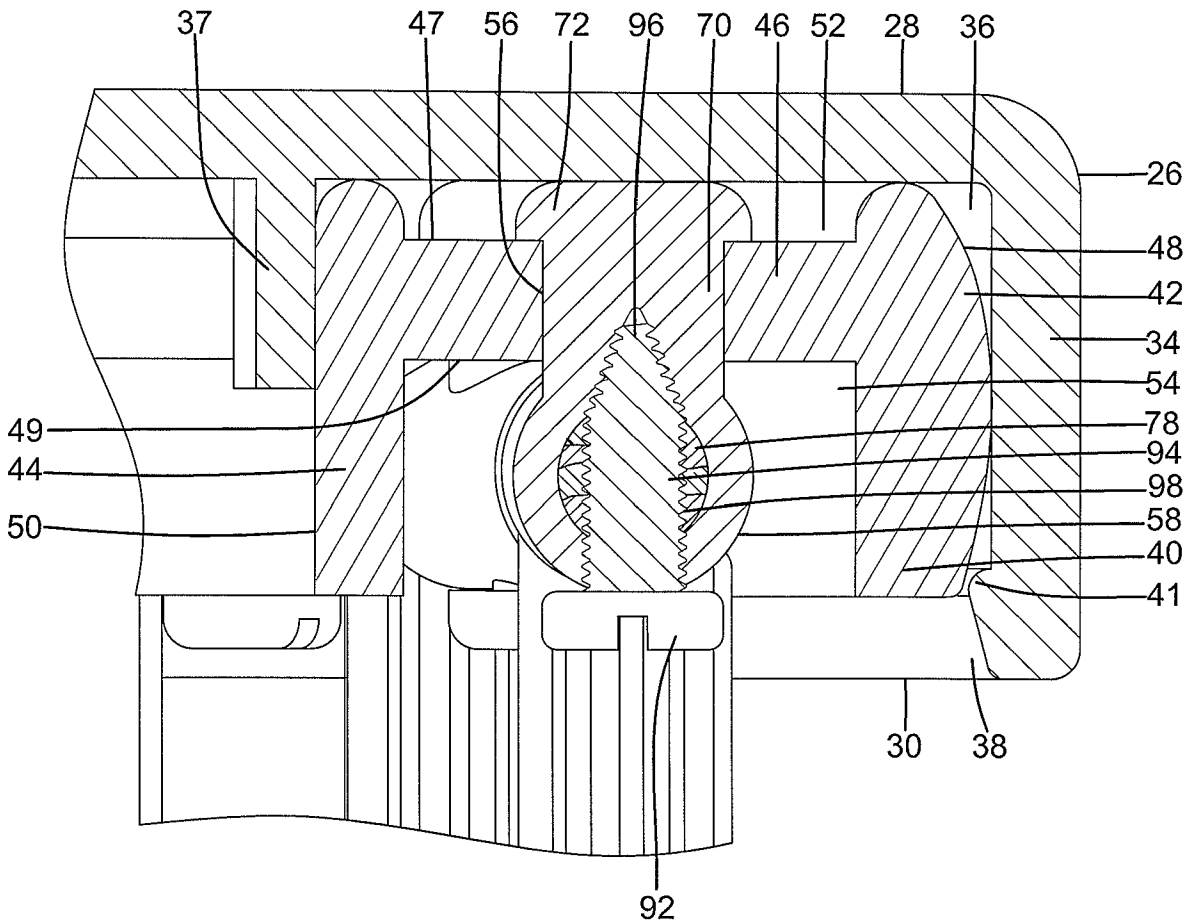
FIG. 4 shows an enlarger view of a portion of the mop of FIG. 2.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "end", "portion", "section", "longitudinal", "radial", "annular", "inwards", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A cloth disc assembly according to the preferred teachings of the present invention is shown in the drawings and generally designated 12. Cloth disc assembly 12 can be mounted to a stick assembly 10 to form a mop. According to the preferred form shown, stick assembly 10 includes a stick 20 extending in a longitudinal direction that is perpendicular or transverse to the ground during use. One of two ends 21 of stick 20 includes a connecting member 22 having a pivotal portion 24. Stick assembly 10 further includes a coupler 84 having a pivotal portion 86 and a flange 88. Pivotal portion 86 includes a pivotal groove 90 receiving pivotal portion 24, such that connecting member 22 is pivotally connected to coupler 84 and pivotable about an axis perpendicular to the longitudinal axis of stick 20. Stick assembly 10 further includes a cap 26 pivotably connected to coupler 84. Cap 26 includes upper and lower faces 28 and 30 spaced along the longitudinal axis of stick 20. An annular wall 34 extends along an outer periphery of cap 26 with a compartment 36 formed between lower face 30 and annular wall 34. Compartment 36 has an opening 38 below lower face 30. Four ribs 37 are formed on lower face 30 and spaced in a circumferential direction about the longitudinal axis of stick 20. Four engaging members 43 are formed on lower face 30 and spaced in the circumferential direction. Each engaging member 43 is radially inwards of one of ribs 37 which, in turn, are radially inwards of annular wall 34. An inner lip 41 extends radially from an inner periphery of annular wall 34 into opening 38. A through-hole 39 extends from lower face 30 through upper face 28 along the longitudinal axis of stick 20. Cap 26 is pivotably mounted behind coupler 84 with flange 88 of coupler 84 received in compartment 36 and abutting lower face 30 and with pivotal portion 86 of coupler 84 extending through through-hole 39 and pivotally connected to pivotal portion 24 of connecting member 22. Stick assembly 10 further includes an engaging member 100 for engaging with cap 26. Specifically, engaging member 100 is engaged with engaging members 43 of cap 26 such that engaging member 100 is jointly rotatable with cap 26 about the longitudinal axis of stick 10. Engaging member 100 rotatably holds flange 88 of coupler 84 and prevents cap 26 from moving relative to coupler 84 along the longitudinal axis of stick 10.

According to the preferred form shown, cloth disc assembly 12 includes a disc 40 having a ring 46 with upper and lower surfaces 47 and 49 spaced along a longitudinal axis of disc 40 that is coaxial to the longitudinal axis of stick 10 in the most preferred form shown. Ring 46 includes inner and outer peripheries spaced in a radial direction perpendicular to the longitudinal axis of disc 40. An outer annular wall 42 is formed along an outer periphery of ring 46 and has an outer periphery 48. An inner annular wall 44 is formed along an inner periphery of ring 46 and radially inwards of outer annular wall 42. An upper annular groove 52 is formed between upper surface 47 and inner and outer annular walls 44 and 42. A lower annular groove 54 is formed between lower surface 49 and inner and outer annular grooves 44 and 42. In the most preferred form shown, a depth of upper annular groove 52 along the longitudinal axis of disc 40 is smaller than that of lower annular groove 54 along the longitudinal axis of disc 40. Furthermore, a plurality of annularly spaced engaging holes 56 is extended from upper surface 47 through lower surface 49 along the longitudinal axis of disc 40, communicating upper annular groove 52 with lower annular groove 54. A plurality of reinforcing ribs 45 is extended between an inner periphery of inner annular wall 44 and a central hub having a central through-hole 57. Reinforcing ribs 45 reinforce the structural strength of disc 40 to avoid deformation.

According to the preferred form shown, cloth disc assembly 12 further includes a plurality of fixing members 58 fixed in engaging holes 56 of disc 40. Each fixing member 58 includes a hollow cylinder 60 having two end faces 62. A longitudinal hole 64 extends from one end face 62 through the other end face 62 of cylinder 60 and has an inner periphery 66. Cylinder 60 includes an outer periphery extending between end faces 62. An engaging section 70 is formed on the outer periphery of cylinder 60 and has an enlarged head 72. In the most preferred form shown, enlarged head 72 is domed and has an diameter larger than an inner diameter of engaging hole 56 by 1-3 mm. Furthermore, a fixing hole 68 in the most preferred form shown as a screw hole extends from the outer periphery of cylinder 60 through inner periphery 66 of longitudinal hole 64 of cylinder 60. Fixing hole 68 is spaced from engaging section 70 in a diameter direction of cylinder 60 perpendicular to longitudinal hole 64. A receptacle 74 extends from inner periphery 66 of cylinder 60 into engaging section 70. In the most preferred form shown, receptacle 74 is a conical screw hole aligned with fixing hole 68.

Figure 5:
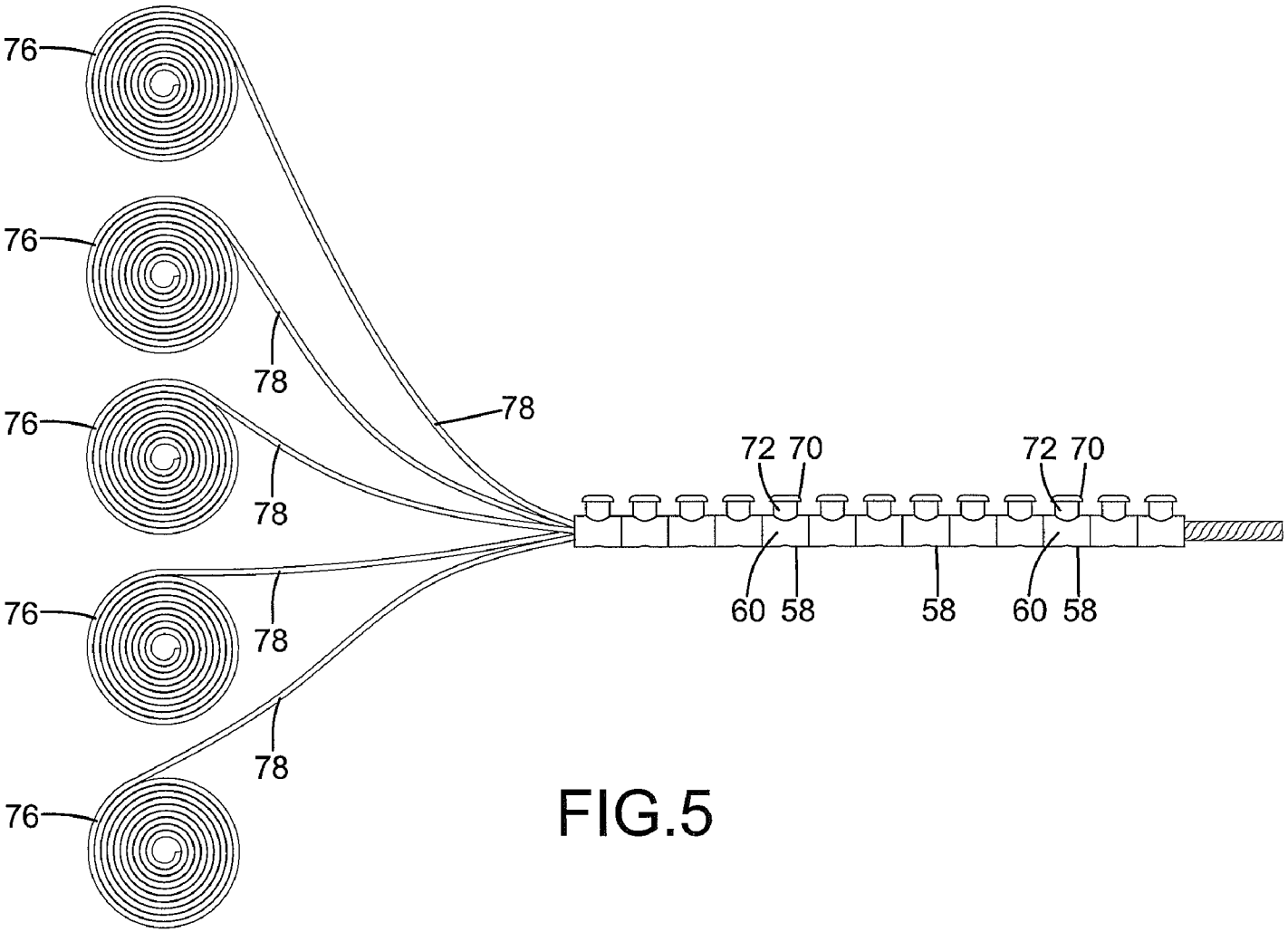
FIG. 5 shows a schematic view illustrating a rope formed by a plurality of cleaning strips for forming cleaning units, with the rope extending through fixing members of the cloth disc assembly according to the preferred teachings of the present invention.
Figure 6:
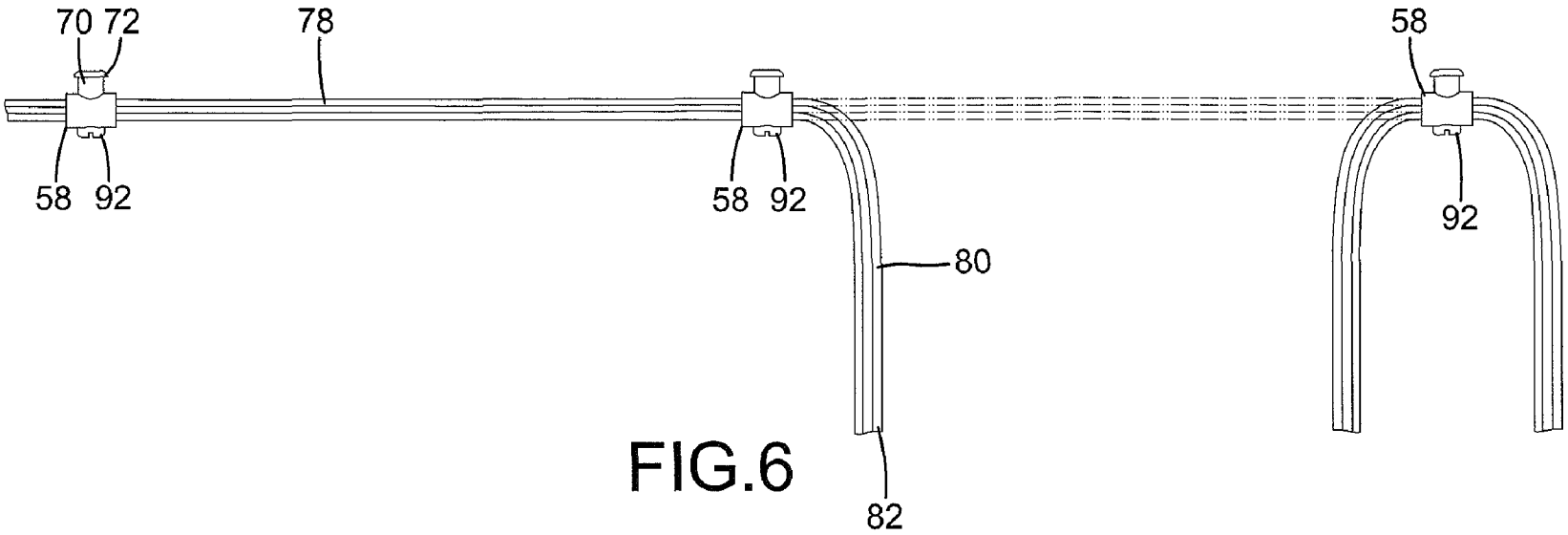
FIG. 6 shows a schematic view illustrating cutting of the rope to form the cleaning unit after the fixing members are spaced from each other by an appropriate spacing.

According to the preferred form shown, cloth disc assembly 12 further includes a plurality of cleaning units 80 mounted to fixing members 58. Each cleaning unit 80 is formed by a plurality of cleaning strips 78 made of cloth or cotton. In the most preferred form shown, each cleaning strip 78 is initially wound in a coil (FIG. 5). Outer ends of cleaning strips 78 are bundled and entwisted to form a rope having an end that is small enough to extend through longitudinal holes 64 of a plurality of aligned fixing members 58. Fixing members 58 can be moved along the rope until they are spaced at desired intervals. The rope section between two adjacent fixing members 58 is then cut at the middle point. Thus, a plurality of cleaning units 80 is provided and each have a mediate portion held in one of fixing members 58 with two distal ends 82 of each cleaning unit 80 outside of and dangling from end faces 62 of cylinder 60.

According to the preferred form shown, cloth disc assembly 12 further includes a positioning member 92 mounted to each fixing member 58. Each positioning member 92 is a screw in the most preferred form shown and includes a shank 94 having a conic end 96. Shank 94 has a threaded outer periphery 98 and is received in fixing hole 68 with end 96 engaged in receptacle 74. Each cleaning strip 78 is squeezed by outer periphery 98 of shank 94 of one of positioning members 92 to press against inner periphery 66 of longitudinal hole 64, avoiding disengagement of cleaning strip 78 from fixing member 58.

Each fixing member 58 with cleaning unit 80 is engaged with one of engaging holes 56 to form cloth disc assembly 12 with engaging section 70 of fixing member 58 received in engaging hole 56, with enlarged head 72 received in upper annular groove 52 and abutting upper surface 49 of ring 46, and with cylinder 60 received in lower annular groove 54. Lower surface 49 is intermediate upper surface 47 and cylinder 60 along the longitudinal axis of disc 40. Disc 40 of cloth disc assembly 12 is detachably mounted in compartment 36 of cap 26 with outer periphery 48 of outer annular wall 42 abutting the inner periphery of annular wall 34, with inner lip 41 abutting a lower end of outer annular wall 42, and with inner periphery 50 of inner annular wall 44 abutting outer faces of ribs 37. Engaging member 100 is received in through-hole 57. Cap 26 can rotate jointly with disc cloth assembly 12 about the longitudinal axis of disc cloth assembly 12 due to friction. Distal ends 82 of each cleaning unit 80 are extended outside of cap 26 via opening 38. Cleaning units 80 can be utilized to clean floors. Cloth disc assembly 12 can be utilized with a dehydrating cylinder of any desired form as conventional including but not limited to of a commercially available type.

Cloth disc assembly 12 according to the preferred teachings of the present invention can be manufactured rapidly in mass production through use of fixing members 58 and cleaning strips 78, reducing the manufacturing costs.

Now that the basic teachings of the present invention have been explained, many extensions and variations will be obvious to one having ordinary skill in the art. For example, cloth disc assembly 12 can be utilized with stick assembly 10 of other types and forms according to the teachings of the present invention. Furthermore, disc 40 does not have to include inner and outer annular walls 44 and 42 and upper and lower annular grooves 52 and 54. In this case, inner lip 41 of cap 26 is located in a position abutting lower surface 49 of disc 40 while allowing detachment of disc 40 from cap 26 and without adversely affecting engagement of fixing members 58 with engaging holes 56. Furthermore, fixing member 58 does not have to include enlarged head 72. Instead, engaging section 70 can include a protrusion or hole, and the inner periphery of engaging hole 56 of cap 26 can include a hole or protrusion for engaging with the hole or protrusion of engaging section 70. Further, positioning member 92 does not have to include an enlarged head such that positioning member 92 can be completely received in cylinder 60.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cloth disc assembly for a mop comprising:

a disc including a ring having upper and lower surfaces spaced along a longitudinal axis of the disc, with a plurality of engaging holes each extending from the upper surface through the lower surface along the longitudinal axis of the disc, with the disc adapted to be coupled to a stick of the mop;

a plurality of fixing members each mounted to one of the plurality of engaging holes, with each of the plurality of fixing members including a cylinder having first and second end faces, with the cylinder of each of the plurality of fixing members including a longitudinal hole extending from the first end face through the second end face of the cylinder and having an inner periphery, with the cylinder of each of the plurality of fixing members further including an outer periphery extending between the first and second end faces and having an engaging section formed on the outer periphery of the cylinder, with the engaging section of the cylinder of each of the plurality of fixing members engaged in one of the plurality of engaging holes with the lower surface of the ring intermediate the upper surface of the ring and the cylinder along the longitudinal axis of the disc, with the cylinder of each of the plurality of fixing members further including a fixing hole extending from the outer periphery of the cylinder through the inner periphery of the longitudinal hole of the cylinder;

a plurality of cleaning units each extending through the longitudinal hole of the cylinder of one of the plurality of fixing members, with each of the plurality of cleaning units including a plurality of cleaning strips each having two ends extending out of the first and second end faces of the cylinder and outside of the disc; and a plurality of positioning members each mounted to one of the plurality of fixing members, with each of the plurality of positioning members including a shank extending through the fixing hole of the cylinder of one of the plurality of fixing members into the longitudinal hole of the cylinder and pressing the plurality of cleaning strips against the inner periphery of the longitudinal hole of the cylinder.

2. The cloth disc assembly as claimed in claim 1, with the engaging section of each of the plurality of fixing members including an enlarged head outside of the engaging holes, with the enlarged head of each of the plurality of fixing members abutting the upper surface of the ring.

3. The cloth disc assembly as claimed in claim 2, with the ring including inner and outer peripheries spaced in a radial direction perpendicular to the longitudinal axis of the disc, with an outer annular wall formed along the outer periphery of the ring, with an inner annular wall formed along the inner periphery of the ring and radially inwards of the outer annular wall, with an upper annular groove formed between the upper surface and the inner and outer annular walls, with a lower annular groove formed between the lower surface and the inner and outer annular walls, with the cylinder of each of the plurality of fixing members received in the lower annular groove, with the enlarged head of each of the plurality of fixing members received in the upper annular groove.

4. The cloth disc assembly as claimed in claim 1, with the fixing hole of the cylinder of each of the plurality of fixing members being a screw hole, with a receptacle extending from the inner periphery of the longitudinal hole of the cylinder of each of the plurality of fixing members into the engaging section of the fixing member, with the receptacle being a conical screw hole aligned with the fixing hole, with the shank including a threaded outer periphery engaged in the screw hole and having an end engaged in the conic screw hole.

5. The cloth disc assembly as claimed in claim 4, with the engaging section of each of the plurality of fixing members including an enlarged head outside of the engaging holes, with the enlarged head of each of the plurality of fixing members abutting the upper surface of the ring.

6. The cloth disc assembly as claimed in claim 5, with the ring including inner and outer peripheries spaced in a radial direction perpendicular to the longitudinal axis of the disc, with an outer annular wall formed along the outer periphery of the ring, with an inner annular wall formed along the inner periphery of the ring and radially inwards of the outer annular wall, with an upper annular groove formed between the upper surface and the inner and outer annular walls, with a lower annular groove formed between the lower surface and the inner and outer annular walls, with the cylinder of each of the plurality of fixing members received in the lower annular groove, with the enlarged head of each of the plurality of fixing members received in the upper annular groove.

* * * * *